US010421637B1

(12) United States Patent
Huang

(10) Patent No.: US 10,421,637 B1
(45) Date of Patent: Sep. 24, 2019

(54) CRANKING MECHANISM

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 16/166,281

(22) Filed: Oct. 22, 2018

(51) Int. Cl.

| | |
|---|---|
| ***F41B 5/12*** | (2006.01) |
| ***B65H 75/30*** | (2006.01) |
| ***B65H 75/44*** | (2006.01) |
| *B08B 3/02* | (2006.01) |

(52) U.S. Cl.
CPC ..... *B65H 75/30* (2013.01); *B65H 75/4442* (2013.01); *B65H 75/4478* (2013.01); *B65H 75/4494* (2013.01); *F41B 5/12* (2013.01); *B08B 3/02* (2013.01); *B08B 2203/0276* (2013.01)

(58) Field of Classification Search
CPC . F41B 5/12; F41B 5/123; B65H 75/30; B65H 75/4442; B65H 75/4494
See application file for complete search history.

(56) References Cited

U.S. PATENT DOCUMENTS

| | | | | |
|---|---|---|---|---|
| 6,095,128 | A * | 8/2000 | Bednar | F41B 5/1469 124/25 |
| 6,286,496 | B1 * | 9/2001 | Bednar | F41B 5/123 124/25 |
| 6,874,491 | B2 * | 4/2005 | Bednar | F41B 5/10 124/25 |
| 6,913,007 | B2 * | 7/2005 | Bednar | F41B 5/123 124/25 |
| 7,100,590 | B2 * | 9/2006 | Chang | F41B 5/123 124/25 |
| 7,784,453 | B1 * | 8/2010 | Yehle | F41B 5/12 124/25 |
| 8,578,917 | B2 | 11/2013 | Bednar et al. | |
| 8,950,385 | B1 * | 2/2015 | Khoshnood | F41B 5/1469 124/1 |
| 9,341,434 | B2 * | 5/2016 | McPherson | F41B 5/123 |
| 9,404,706 | B2 * | 8/2016 | Khoshnood | F41B 5/1469 |
| 9,599,425 | B2 * | 3/2017 | Barnett | F41B 5/1403 |
| 9,752,844 | B1 * | 9/2017 | Huang | F41B 5/12 |
| 9,958,232 | B1 * | 5/2018 | Egerdee | F41B 5/1403 |
| 10,295,299 | B2 * | 5/2019 | Vergara | B66D 1/04 |

* cited by examiner

*Primary Examiner* — John A Ricci
(74) *Attorney, Agent, or Firm* — Donald J. Ersler

(57) ABSTRACT

A cranking mechanism preferably includes a crank shaft, a one way bearing, a clutch, a reel shaft, a driven gear and at least one reel. The clutch preferably includes a clutch housing, a clutch pack and a pressure washer. The clutch housing includes a clutch pack housing and a drive gear. The one way bearing and the clutch are retained on the crank shaft. A hand knob is threaded on to a threaded end of the crank shaft to exert pressure on the clutch pack. The driven gear is pressed on to the reel shaft. The at least one reel is retained on at least one end of the reel shaft. The hand knob is tightened against the clutch pack to frictionally engage the crank shaft with the drive gear. The drive gear rotates the at least one reel.

20 Claims, 10 Drawing Sheets

CRANKING MECHANISM

BACKGROUND OF THE INVENTION

1. Field of the Invention

The present invention relates generally to cranking a line and more specifically to a cranking mechanism, which utilizes a one way bearing instead of a ratchet mechanism to lock rotation of a reel.

2. Discussion of the Prior Art

Cranking devices typically use a ratchet mechanism to lock tension on a line, string or rope. However, it appears that the prior art does not teach or suggest a cranking mechanism, which utilizes a one way bearing instead of a ratchet mechanism.

Accordingly, there is a clearly felt need in the art for a cranking mechanism, which utilizes a one way bearing instead of ratchet mechanism to lock rotation of a reel.

SUMMARY OF THE INVENTION

The present invention provides a cranking mechanism, which utilizes a one way bearing instead of a ratchet mechanism to lock rotation of a reel. The cranking mechanism preferably includes a crankshaft, a one way bearing, a clutch, a reel shaft, a driven gear and at least one reel. The crankshaft includes a drive end, a bearing diameter, a clutch disc portion, a clutch housing portion and an opposed threaded end. A crank is removably engagable with the drive end. The threaded end is sized to threadably receive a hand knob. The one way bearing is pressed on to the bearing diameter. The clutch preferably includes a clutch housing, a clutch pack and a pressure washer. The clutch housing includes a clutch pack housing and a drive gear. A clutch cavity is formed in one end of the clutch pack housing and a drive gear extends from an opposing end of the clutch pack housing. A shaft bore is formed through the clutch pack housing and the drive gear to rotabably receive the crankshaft. A clutch bearing is preferably pressed onto an outer diameter of the clutch pack housing to rotatably retain crankshaft.

The clutch pack includes a plurality of stationary discs, a plurality of rotating discs and a plurality of friction discs. A single friction disc is located between a rotating disc and a stationary disc. Each rotating disc preferably includes a square shaft opening. The clutch disc portion of the drive shaft includes a square shaped perimeter to receive the square shaft opening. The stationary disc and the friction disc each include a round hole, which is greater than a perimeter of the clutch pack portion of the crank shaft. At least one projection extends from an outer perimeter of the stationary plate. The at least one projection is sized to be received by at least one clutch disc notch in the clutch cavity.

A pressure washer is slipped on to the opposing end of the crankshaft. The pressure washer preferably includes a trapezoidal cross section. The pressure washer includes a small side and an opposing large side. The large side exerts pressure against the clutch pack and the small side is in contact with a compression spring. The hand knob is threaded on to the threaded end of the crankshaft to exert pressure on the clutch pack. The clutch pack exerts pressure on a thrust bearing, which is in contact with the one way bearing.

The reel shaft preferably includes a gear perimeter, a recoil spring notch and a flat surface formed on at least one end to receive at least one reel. The driven gear is pressed onto the gear perimeter. The reel shaft is rotatably retained by a pair of reel shaft bearings located on opposing sides of the driven gear. One end of a recoil spring is attached to the spring notch with a fastener. The other end is secured to any suitable location in a housing to bias the reels to retract a line retained in the at least one reel.

In use, a line, string or rope is retained in the at least one reel. One end of the line, string or rope is inserted through a hole in the at least one reel and secured to the at least one reel. An opposing end of the line, string or rope is attached to some object to be pulled. The hand knob is tightened against the compression spring and clutch pack to frictionally engage the crankshaft with the drive gear. The crank is turned to rotate the drive gear. The drive gear rotates the driven gear which pulls the line, string or rope to an object. The one way bearing prevents the at least one reel from reversing direction and releasing the line, string or rope. The at least one reel is allowed to unreel the line, string or rope by unscrewing the hand knob to disengage the crankshaft from the drive gear.

Accordingly, it is an object of the present invention to provide a cranking mechanism, which utilizes a one way bearing instead of ratchet mechanism to lock rotation of a reel.

These and additional objects, advantages, features and benefits of the present invention will become apparent from the following specification.

DETAILED DESCRIPTION OF THE PREFERRED EMBODIMENTS

Figure 1:
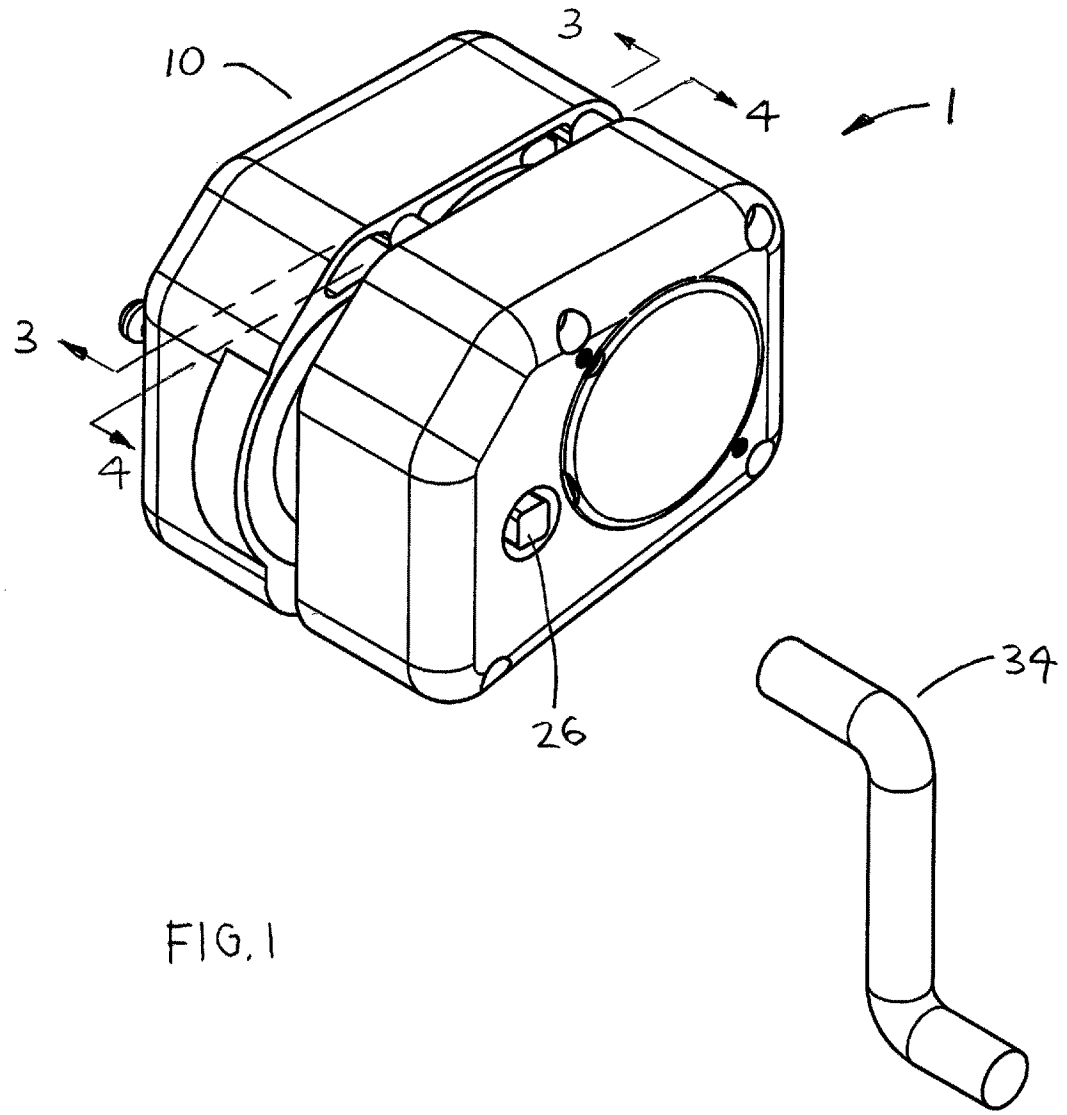
FIG. 1 is a partially exploded perspective view of a cranking mechanism in accordance with the present invention.
Figure 2:
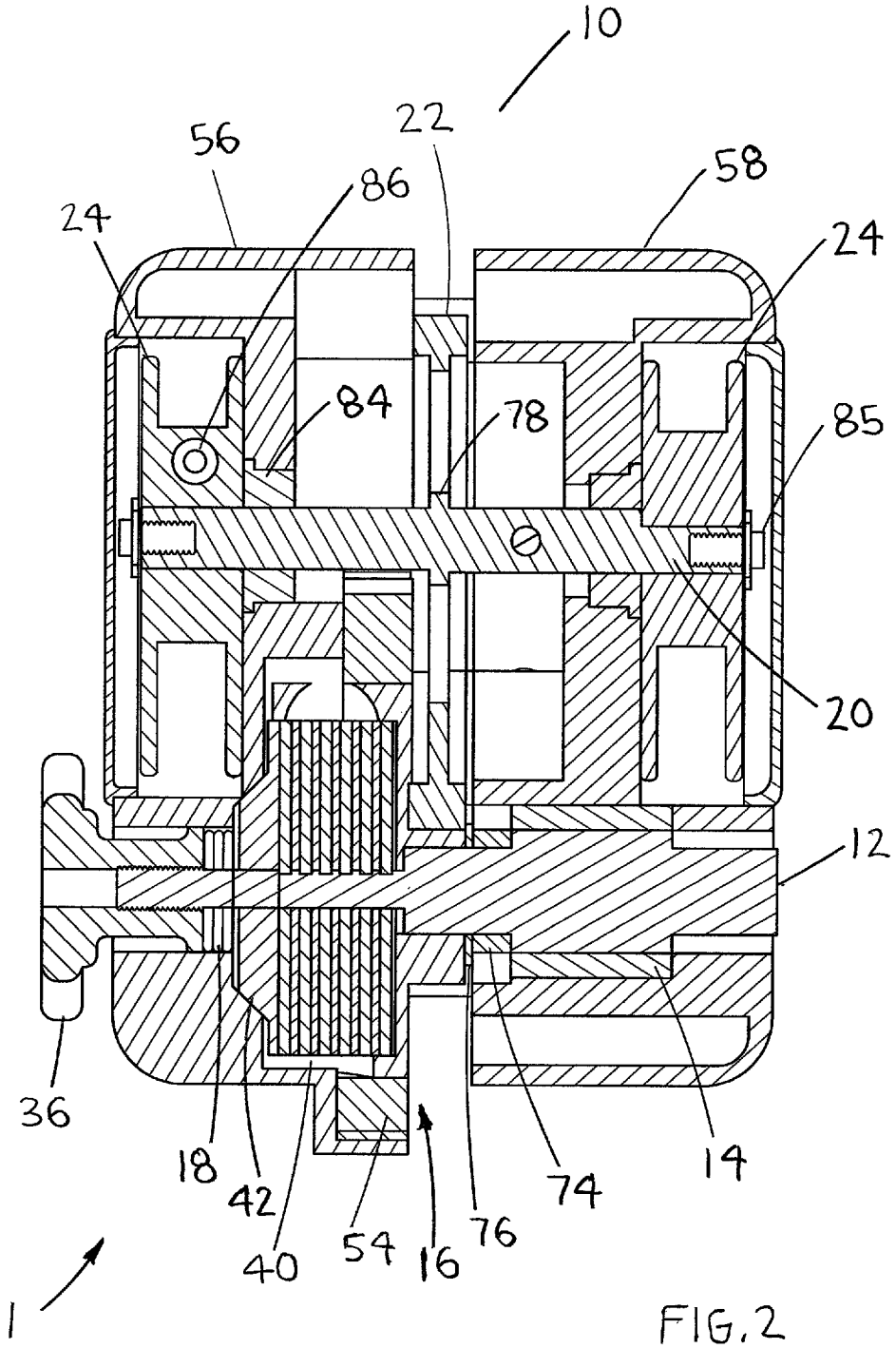
FIG. 2 is a cross sectional view of a cranking mechanism in accordance with the present invention.
Figure 9:
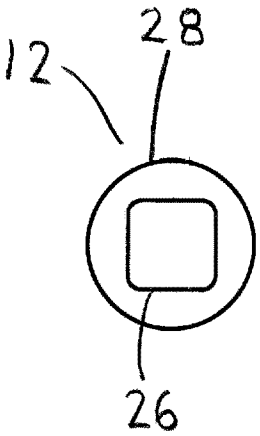
FIG. 9 is an end view of a second end of a cranking shaft of a cranking mechanism in accordance with the present invention.
Figure 8:
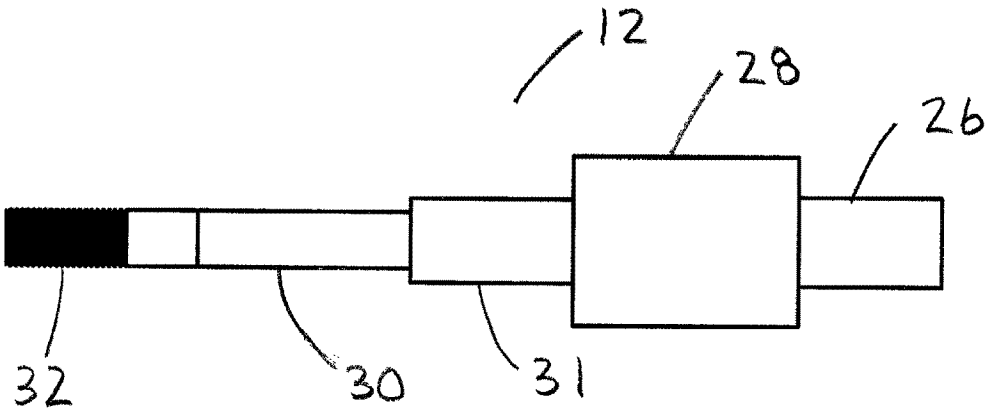
FIG. 8 is a front view of a cranking shaft of a cranking mechanism in accordance with the present invention.
Figure 7:
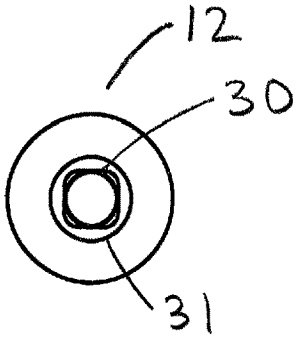
FIG. 7 is an end view of a first end of a cranking shaft of a cranking mechanism in accordance with the present invention.

With reference now to the drawings, and particularly to FIG. 1, there is shown a partially exploded perspective view of a cranking mechanism 1. With reference to FIG. 2, the cranking mechanism preferably includes a housing 10, a crank shaft 12, a one way bearing 14, a clutch 16, a compression spring 18, a reel shaft 20, a driven gear 22 and at least one reel 24. The housing 10 may be replaced with some type of retention structure. The one way bearing 14 eliminates the need for a ratcheting device. With reference to FIGS. 7-9, the crank shaft 12 includes a drive end 26, a bearing diameter 28, a clutch disc portion 30, a clutch housing portion 31 and an opposing threaded end 32. With reference to FIG. 1, a crank 34 is retained on the drive end 26. However, a motorized device may be used to rotate the crank shaft 12 instead of the crank 34. The crank 34 includes a square cavity (not shown), which is sized to receive the square drive end 26. The threaded end 32 is sized to threadably receive a hand knob 36. The one way bearing 14 is pressed on to the bearing diameter 28.

Figure 3:
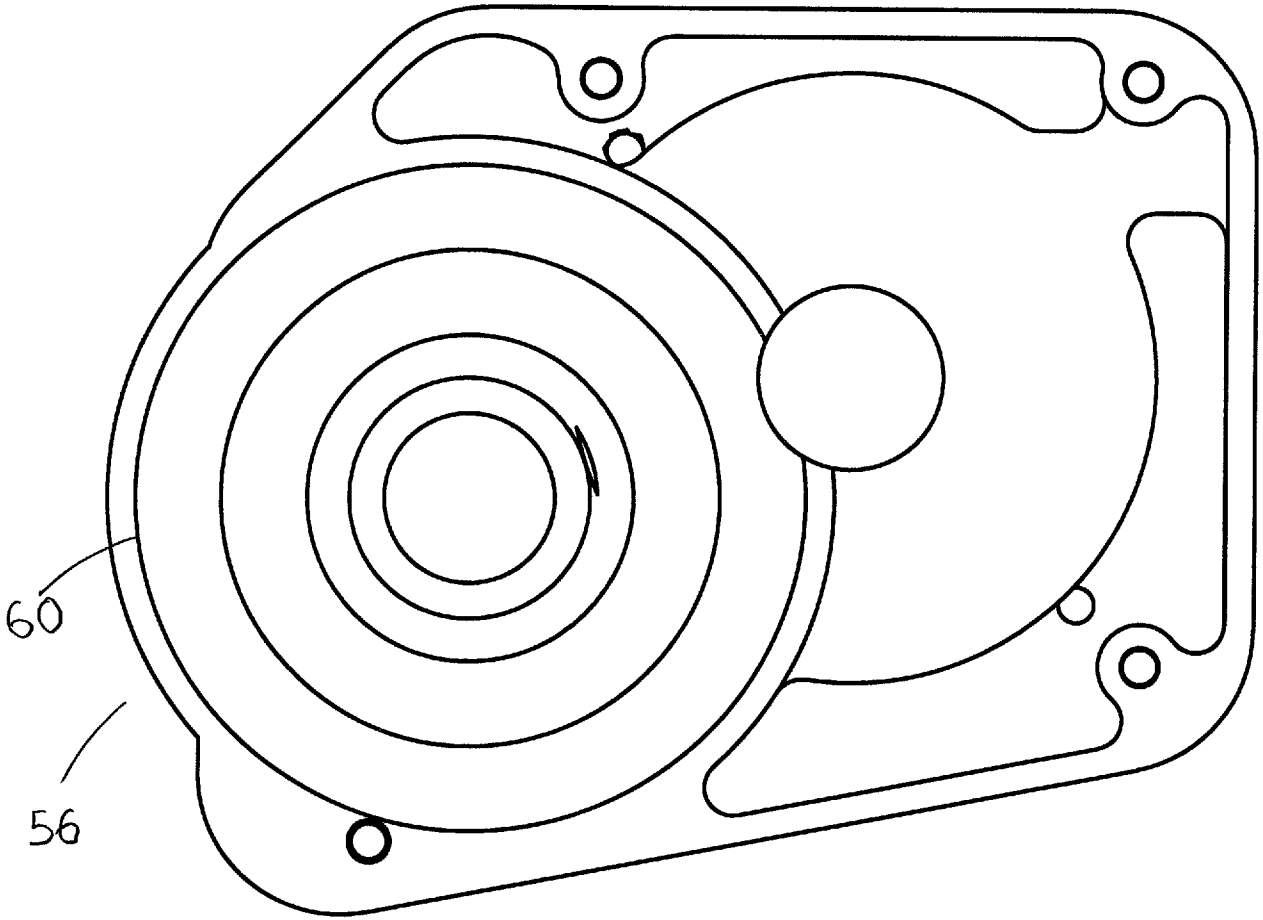
FIG. 3 is an inside side view of a first housing half of a cranking mechanism in accordance with the present invention.
Figure 4:
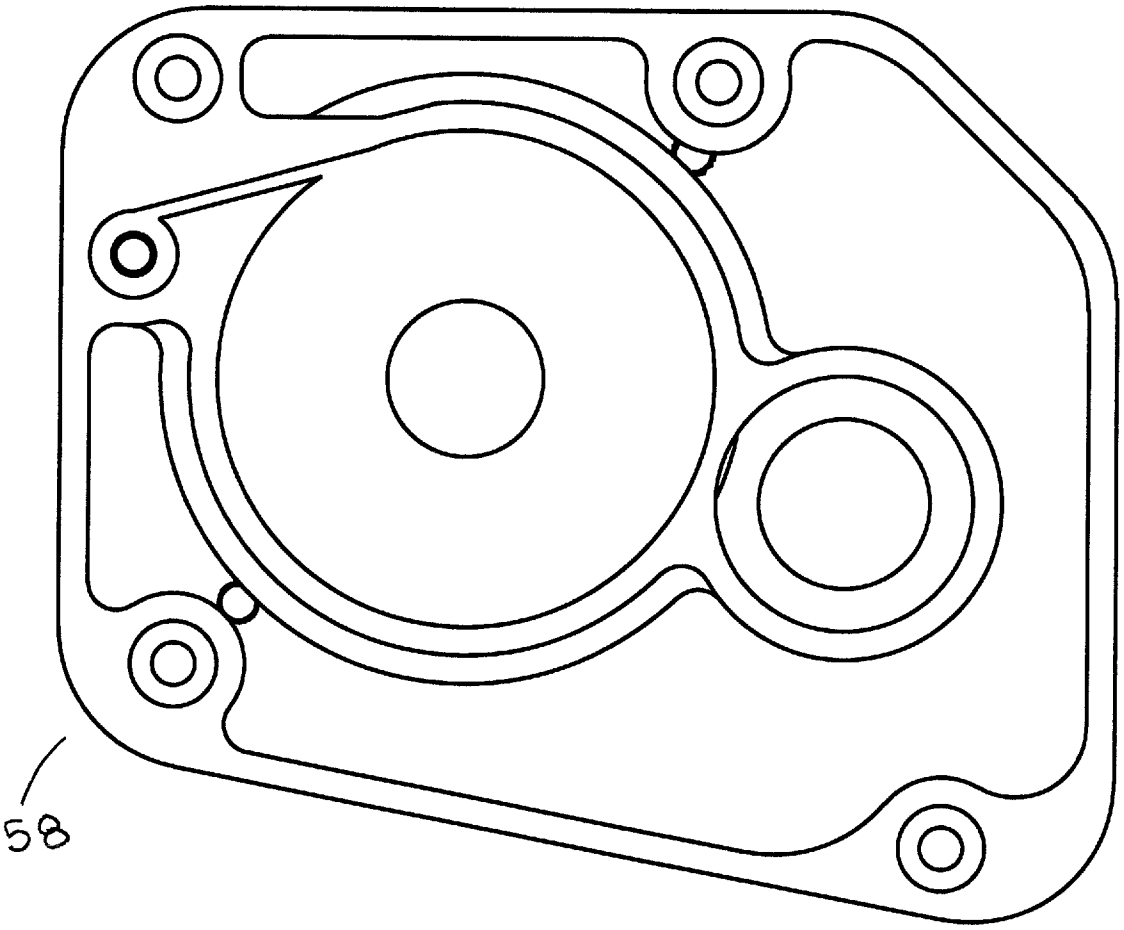
FIG. 4 is an inside side view of a second housing half of a cranking mechanism in accordance with the present invention.
Figure 6:
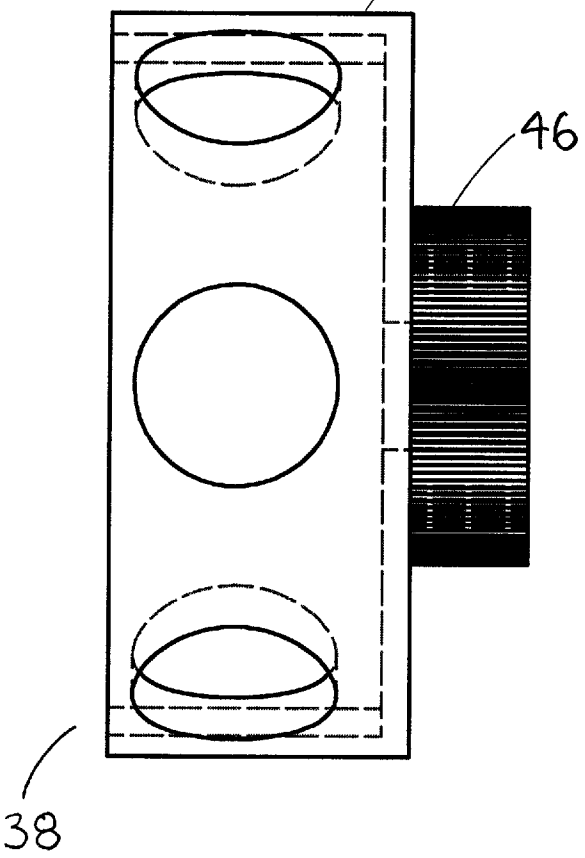
FIG. 6 is a front view of a clutch pack housing in accordance with the present invention.
Figure 5:
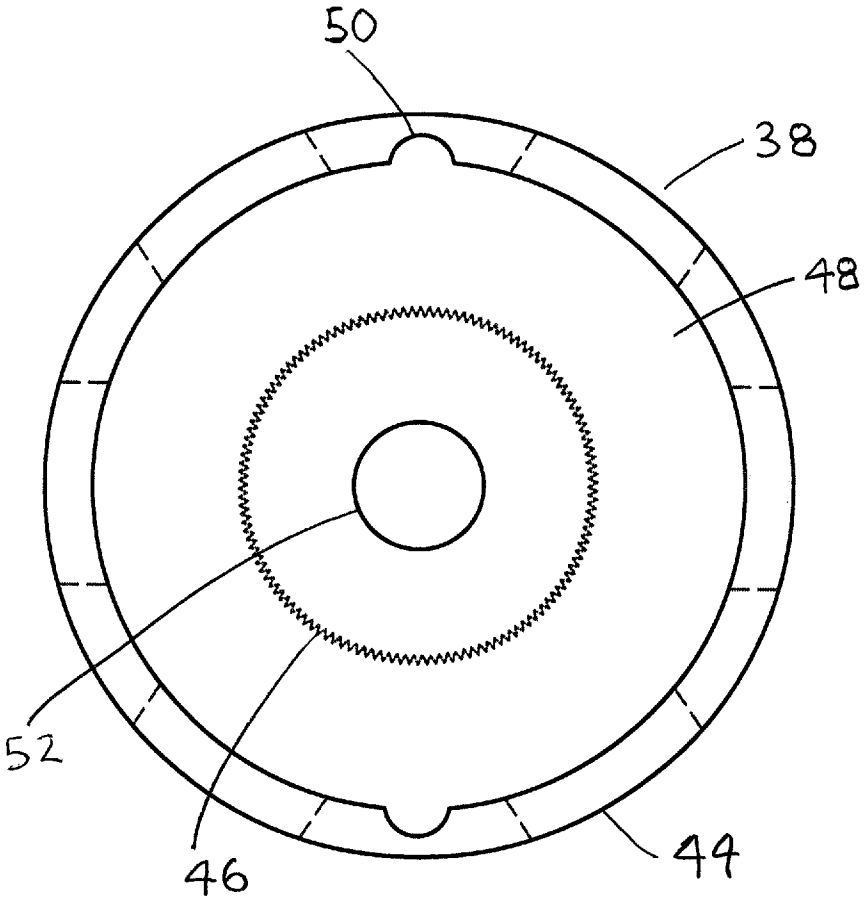
FIG. 5 is an end view of a clutch pack housing in accordance with the present invention.

With reference to FIGS. 5-6, the clutch 16 preferably includes a clutch housing 38, a clutch pack 40 and a pressure washer 42. The clutch housing 38 includes a clutch pack housing 44 and a drive gear 46. A clutch cavity 48 is formed in one end of the clutch pack housing 44 and the drive gear 46 extends from an opposing end of the clutch pack housing 44. At least one clutch disc notch 50 is formed in a side wall of the clutch cavity 48. A shaft bore 52 is formed through the clutch pack housing 44 and the drive gear 46. A shaft bore 52 is formed through the clutch pack housing 44 and the drive gear 46 to rotabably receive the clutch housing portion 31 of the crank shaft 12. A clutch bearing 54 is preferably pressed onto an outer diameter of the clutch pack housing 44 to rotatably retain the crankshaft 12 in the housing 10. With reference to FIGS. 3-4, the housing 10 preferably includes a first housing half 56 and a second housing half 58. The clutch bearing 54 is pressed into a bearing bore 60 in the first housing half 56.

Figure 11:
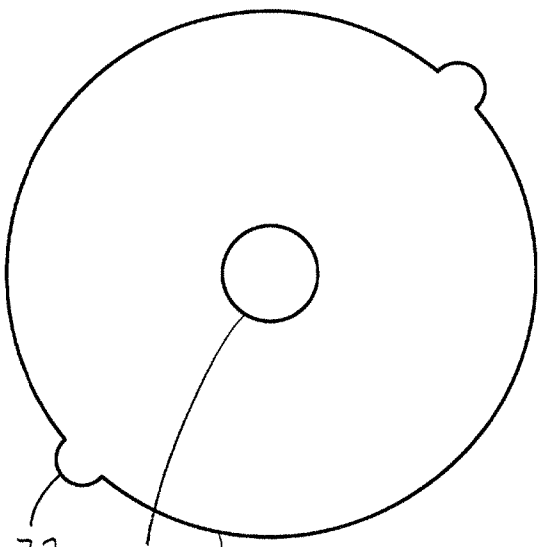
FIG. 11 is an end view of a stationary disc of a cranking mechanism in accordance with the present invention.
Figure 12:
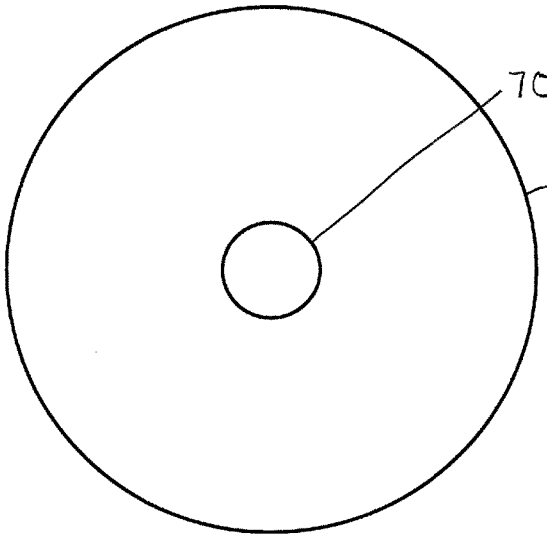
FIG. 12 is an end view of a friction disc of a cranking mechanism in accordance with the present invention.
Figure 10:
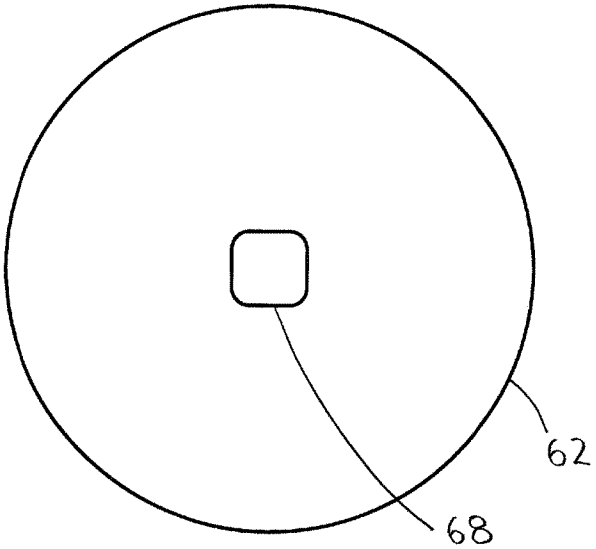
FIG. 10 is an end view of a rotating disc of a cranking mechanism in accordance with the present invention.

With reference to FIGS. 10-12, the clutch pack 40 preferably includes a plurality of rotating discs 62, a plurality of stationary discs 64 and a plurality of friction discs 66. A single friction disc 66 is located between a rotating disc 62 and a stationary disc 64. Each rotating disc 62 preferably includes a square shaft opening 68. The clutch disc portion 30 of the drive shaft 12 includes a square shaped perimeter to receive the square shaft opening 68. The stationary disc 64 and the friction disc each include a round hole 70, which is greater than a perimeter of the clutch pack portion 30 of the crankshaft 12. At least one projection 72 extends from an outer perimeter of the stationary plate 72. The at least one projection 72 is sized to be received by the at least one clutch disc notch 50 in the clutch cavity 48.

The pressure washer 42 is slipped on to the opposing end of the crankshaft 12. The pressure washer 42 preferably includes a trapezoidal cross section. The pressure washer 42 includes a small side and an opposing large side. The large side exerts pressure against the clutch pack 40 and the small side is in contact with the compression spring 18. The hand knob 36 is threaded on to the threaded end 32 of the crank shaft 12 to exert pressure on the clutch pack 40. The clutch pack 40 exerts pressure on a thrust bearing 74, which is in contact with the one way bearing 14 and a thrust washer 76.

Figure 13:
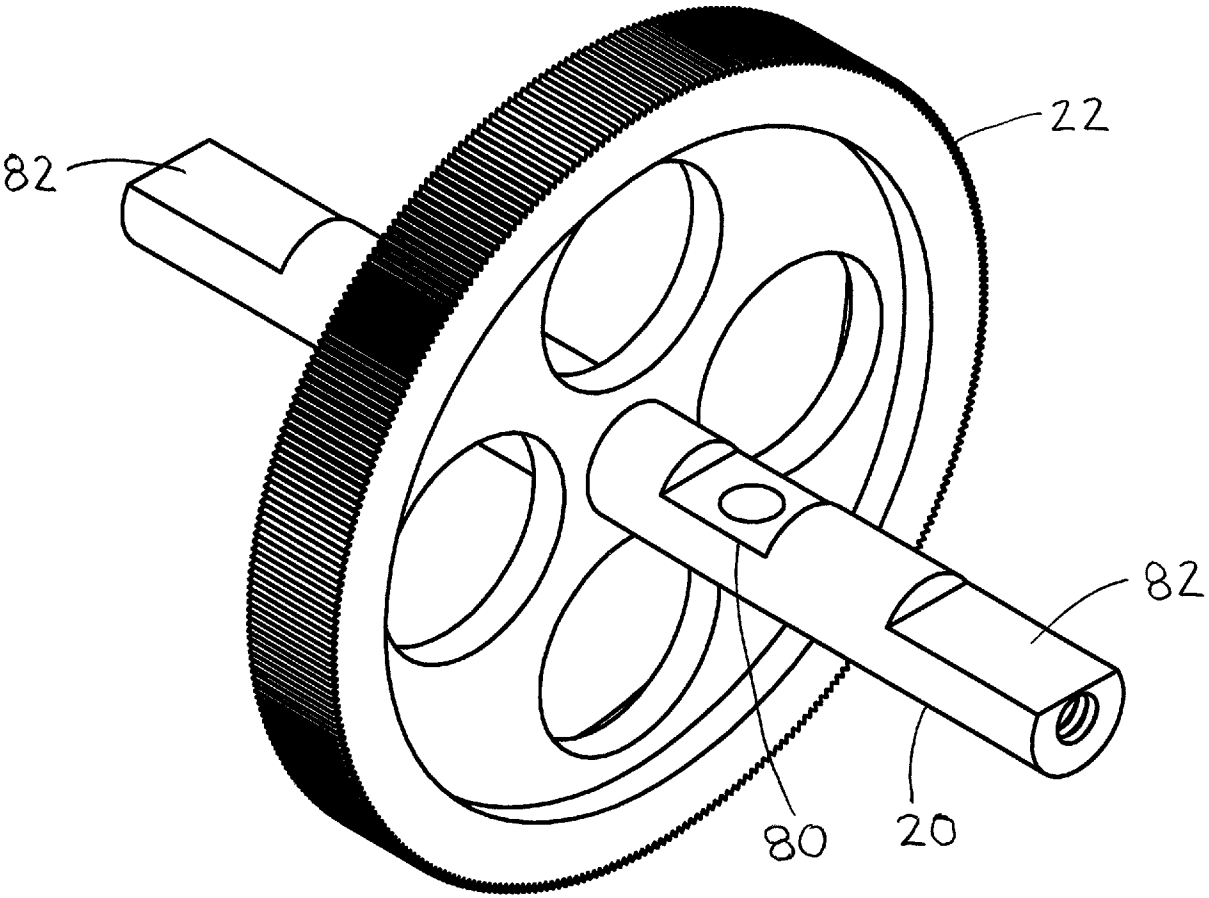
FIG. 13 is a perspective view of a reel shaft with a drive gear retained thereon of a cranking mechanism in accordance with the present invention.

With reference to FIG. 13, the reel shaft 20 preferably includes a gear perimeter 78, a recoil spring notch 80 and a flat surface 82 formed on at least one end to receive the at least one reel 24. The at least one reel 24 is retained on at least one end of the reel shaft 20 with at least one fastener 85. The driven gear 22 is preferably pressed onto the gear perimeter 78 of the reel shaft 20. The reel shaft 20 is rotatably retained by a pair of reel shaft bearings 84, located on opposing sides of the driven gear 22. One end of a recoil spring (not shown) is attached to the spring notch 80 with a fastener. The other end is secured to any suitable location in the second housing 58 to bias the reels to retract a line retained in the at least one reel 24.

Figure 14:
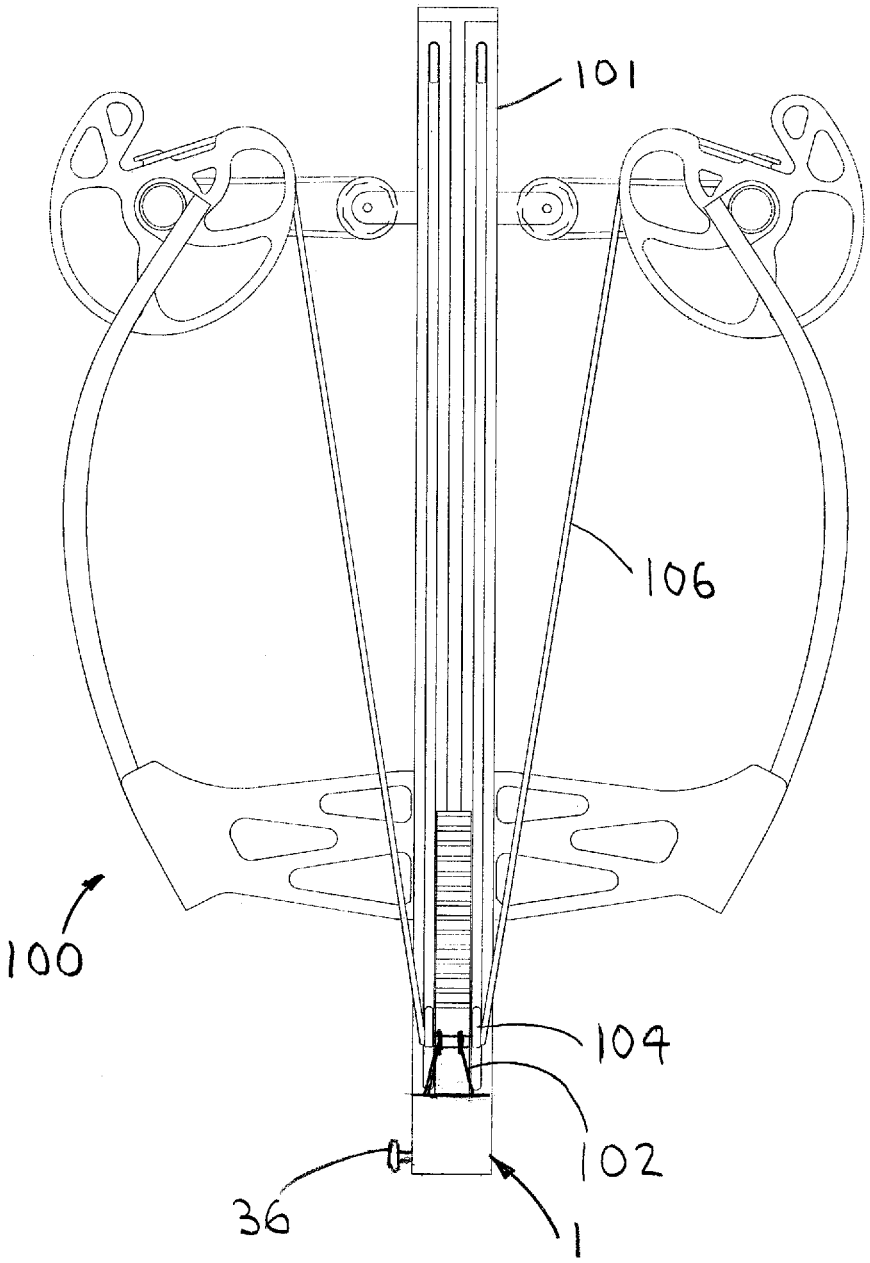
FIG. 14 is a top view of a crossbow with a cranking mechanism holding a bow string in a fully cocked orientation, after a trigger has been pulled in accordance with the present invention.
Figure 15:
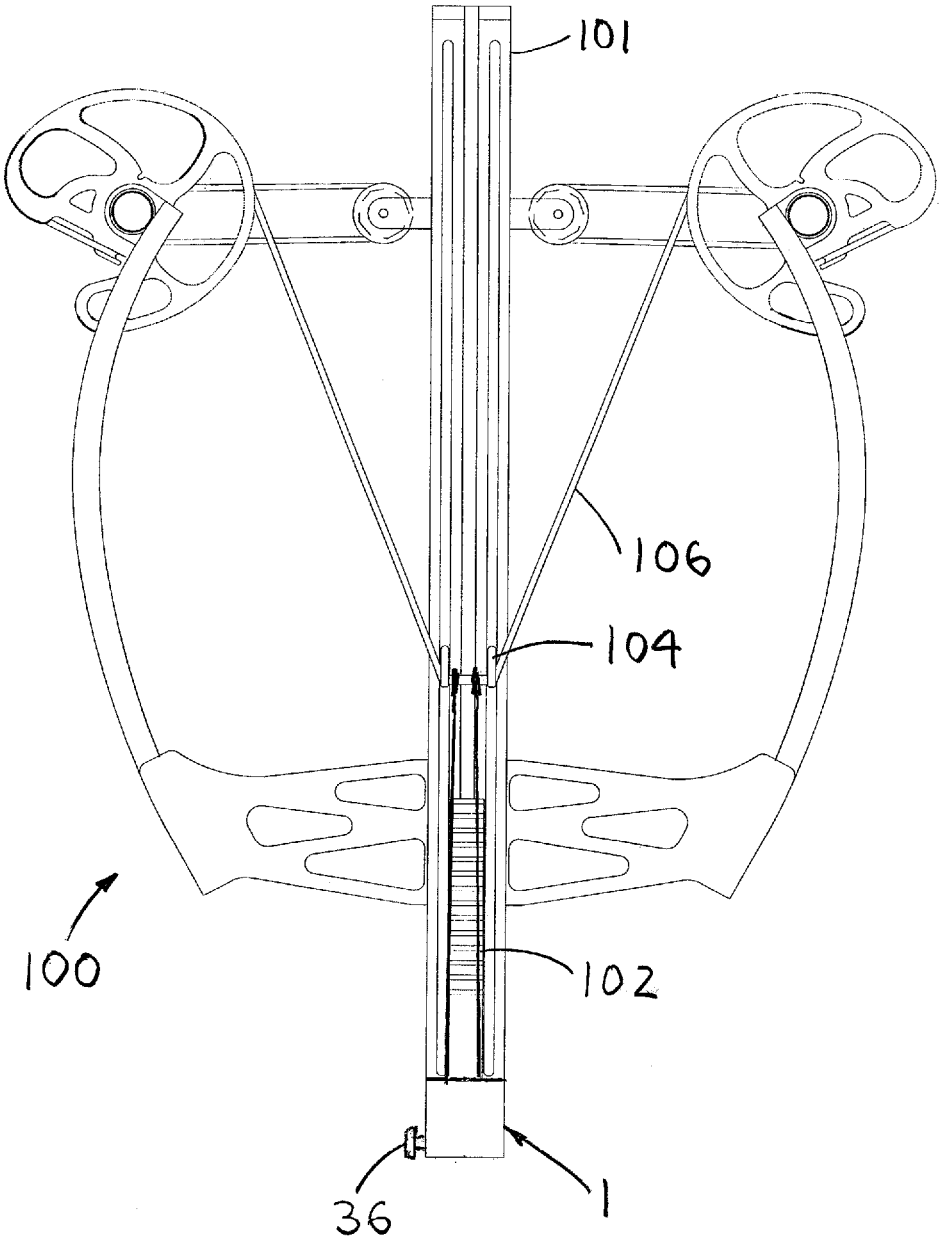
FIG. 15 is a top view of a crossbow with a cranking mechanism, after a trigger has been pulled and a hand knob has been loosened to allow a bow string to move to a half cocked orientation in accordance with the present invention.

With reference to FIGS. 14-15, the cranking mechanism 1 is attached to an end of a barrel 101 of a crossbow 100. An end of a pair of lines 102 extend from the cranking mechanism 1 and are secured to a sled 104. After a trigger (not shown) has been pulled to fire the crossbow 1, there may be a controlled release of the bow string 106 to a rest position by loosening the hand knob 36, which disengages the crank shaft 12 from the drive gear 22.

In use, a line, string or rope is retained in the at least one reel 24. One end of the line, string or rope is inserted through a hole 86 in the at least one reel 24 and secured to the at least one reel 24. The opposing end of the line, string or rope is attached to some object to be pulled. The hand knob 36 is tightened against the compression spring 18 and the clutch pack 40 to frictionally engage the crankshaft 12 with the drive gear 46. The crank 34 is turned to rotate the drive gear 46. The drive gear 46 rotates the driven gear 22, which pulls the line, string or rope. The one way bearing 14 prevents the at least one reel 24 from reversing direction and releasing the line, string or rope. The at least one reel 24 is allowed to unreel the line, string or rope by loosening the hand knob 36 to disengage the crank shaft 12 from the drive gear 22.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cranking mechanism comprising:

a crank shaft;

a one way bearing is retained on one end of said crank shaft;

a tightening device is threadably enagaged with an opposing end of said crank shaft;

a clutch is retained on said crank shaft, said clutch includes a drive gear;

a reel shaft;

a driven gear is retained on said reel shaft; and at least one reel is retained on at least one end of said reel shaft, wherein rotation of said tightening device causes said clutch to have engagement with said crankshaft, rotation of said crank shaft rotates said at least one reel.

2. The cranking mechanism of claim 1, further comprising:

said clutch includes a clutch housing and a clutch pack, said clutch housing includes a clutch pack housing and a drive gear, a clutch cavity is formed in one end of said clutch pack housing, said drive gear extends from an opposing end of said clutch pack housing, said clutch pack is retained in said clutch cavity.

3. The cranking mechanism of claim 2, further comprising:

a pressure washer is located between said tightening device and said clutch pack.

4. The cranking mechanism of claim 2, further comprising:

a clutch bearing is retained on an outside diameter of said clutch housing, said clutch bearing is retained in a retention structure.

5. The cranking mechanism of claim 1, further comprising:

a thrust bearing is located between said drive gear and said one way bearing.

6. The cranking mechanism of claim 5, further comprising:

a thrust washer is located between said thrust bearing and said drive gear.

7. The cranking mechanism of claim 1, further comprising:

a controlled release of a bow string from a drawn position to a rest position is implemented by loosening said tightening device, which disengages said crank shaft from said drive gear.

8. A cranking mechanism comprising:

a crank shaft;

a one way bearing is retained on one end of said crank shaft;

a tightening device is threadably enagaged with an opposing end of said crank shaft;

a clutch is retained on said crank shaft between said one way bearing and said tightening device, said clutch includes a drive gear;

a reel shaft;

a driven gear is retained on said reel shaft; and at least one reel is retained on at least one end of said reel shaft, wherein rotation of said tightening device causes said clutch to have engagement with said crank shaft, rotation of said crank shaft rotates said at least one reel.

9. The cranking mechanism of claim 8, further comprising:

said clutch includes a clutch housing and a clutch pack, said clutch housing includes a clutch pack housing and a drive gear, a clutch cavity is formed in one end of said clutch pack housing, said drive gear extends from an opposing end of said clutch pack housing, said clutch pack is retained in said clutch cavity.

10. The cranking mechanism of claim 9, further comprising:

a pressure washer is located between said tightening device and said clutch pack.

11. The cranking mechanism of claim 9, further comprising:

a clutch bearing is retained on an outside diameter of said clutch housing, said clutch bearing is retained in a retention structure.

12. The cranking mechanism of claim 8, further comprising:

a thrust bearing is located between said drive gear and said one way bearing.

13. The cranking mechanism of claim 12, further comprising:

a thrust washer is located between said thrust bearing and said drive gear.

14. The cranking mechanism of claim 8, further comprising:

a controlled release of a bow string from a drawn position to a rest position is implemented by loosening said tightening device, which disengages said crank shaft from said drive gear.

15. A cranking mechanism comprising:

a crank shaft;

a one way bearing is retained on one end of said crank shaft;

a tightening device is threadably enagaged with an opposing end of said crank shaft;

a clutch is retained on said crank shaft, said clutch includes a drive gear;

a compression spring is located on said crank shaft between said clutch and said tightening device;

a reel shaft;

a driven gear is retained on said reel shaft, rotation of said drive gear rotates said driven gear; and at least one reel is retained on at least one end of said reel shaft, wherein rotation of said tightening device causes said clutch to have engagement with said crank shaft, rotation of said crank shaft rotates said at least one reel.

16. The cranking mechanism of claim 15, further comprising:

said clutch includes a clutch housing and a clutch pack, said clutch housing includes a clutch pack housing and a drive gear, a clutch cavity is formed in one end of said clutch pack housing, said drive gear extends from an opposing end of said clutch pack housing, said clutch pack is retained in said clutch cavity.

17. The cranking mechanism of claim 16, further comprising:

a clutch bearing is retained on an outside diameter of said clutch housing, said clutch bearing is retained in a retention structure.

18. The cranking mechanism of claim 15, further comprising:

a pressure washer is located between said compression spring and said clutch pack.

19. The cranking mechanism of claim 15, further comprising:

a thrust bearing is located between said drive gear and said one way bearing.

20. The cranking mechanism of claim 15, further comprising:

a controlled release of a bow string from a drawn position to a rest position is implemented by loosening said tightening device, which disengages said crank shaft from said drive gear.

* * * * *